United States Patent [19]

Takiguchi et al.

[11] 4,408,554

[45] Oct. 11, 1983

[54] AUTOMATIC NEEDLE THREAD CONTROL APPARATUS

[75] Inventors: Michitaka Takiguchi, Anjo; Fujio Horie, Nagoya, both of Japan

[73] Assignee: Brother Kogyo Kabushiki Kaisha, Japan

[21] Appl. No.: 229,087

[22] Filed: Jan. 28, 1981

[30] Foreign Application Priority Data

Jan. 29, 1980 [JP] Japan ..... 55-9006

[51] Int. Cl.[3] ..... D05B 49/00; D05B 47/04

[52] U.S. Cl. ..... 112/302; 112/243; 112/278

[58] Field of Search ..... 112/322, 278, 241, 255, 112/243, 302

[56] References Cited

U.S. PATENT DOCUMENTS 4,215,641 8/1980 Dobnjanskyj et al. ..... 112/278

4,295,435 10/1981 Uemura et al. ..... 112/322

*Primary Examiner*—Werner H. Schroeder

*Assistant Examiner*—Andrew M. Falik

*Attorney, Agent, or Firm*—Leydig, Voit, Osann, Mayer & Holt, Ltd.

[57] ABSTRACT

An automatic thread regulating system having an adjustment mechanism for controlling the thread feed and takeup during the formation of a sewing machine stitch. A central processing unit calculates the length of thread required for a specific stitch formation based on work piece thickness and stitch length. This information is directed to the adjustment mechanism which thereby regulates the appropriate thread amount by feed rolls and a suction apparatus.

4 Claims, 8 Drawing Figures

AUTOMATIC NEEDLE THREAD CONTROL APPARATUS

BACKGROUND OF THE INVENTION

This invention relates to an automatic thread handling system and, more particularly, to a system for controlling the needle thread for formation of each stitch.

In prior-art sewing machines, needle thread control was effected by tensioning the needle thread by a pair of discs mounted in the thread path between the thread supply and the eye of the needle. Such systems necessitate manual operation of a tension setting dial before sewing, so that a tension suitable for the impending sewing operation is applied by the discs to the needle thread. Thus, a complicated operation is required in preparation for sewing, and several trial sewing operations must usually be carried out to achieve neat stitches.

In order to overcome this problem, a variety of automatic thread handling systems have been devised, one example of which is disclosed in U.S. Pat. No. 4,215,641. The automatic needle thread control in these prior art systems is common in the following respects. That is, a thread-extracting mechanism is provided for extracting the needle thread from the thread supply and replenishing the thread used in the stitch formation. A computer calculates the length of thread to be extracted, based on work thickness and stitch length, and the resulting value is used to control the operation of the thread-extracting mechanism The thread thus extracted is taken up by a thread take-up mechanism including a take-up lever having a well-known characteristic illustrated by the solid-line curve in FIG. 4. The take-up mechanism is mechanically or electrically synchronized with the main shaft of the sewing machine for synchronizing the operation of the take-up lever with the vertical motion of the needle. The prior-art automatic thread handling systems are highly effective in reducing the work load of the operators in making preparations for sewing; however, the overall mechanical and electrical structures are rather complicated because of the necessity of incorporating the thread-extracting mechanism, in addition to the thread take-up mechanism, into the narrow space available within the head of the sewing machine.

SUMMARY OF THE INVENTION

It is, therefore, an object of the present invention to provide an automatic thread handling system having an improved thread-regulating mechanism for setting the length of needle thread needed to form each stitch and for taking up the thread from the needle.

For realizing this object, the automatic thread handling system of the present invention has a regulating mechanism mounted along a thread path leading from the thread supply to the needle, and a central processing unit for controlling the drive of the regulating mechanism based on work thickness and stitch length, the length of needle thread supplied for each stitch being set by the controlled drive of the regulating mechanism.

As is well known, the length of the needle thread used for the loop formed and expanded by the rotation of the looptaker is that necessary for forming a loop of fixed size as determined by the mechanical design of the machine. The needle thread is extracted from the thread supply mainly under the action of the looptaker rotation and is fed toward the needle. The needle thread length required for formation of each stitch is determined by stitch length and thickness of the workpiece being sewed.

The regulating mechanism of the present invention may be a reversible device which supplies the required length of needle thread prior to loop contraction and takes up the desired length of thread during such contraction. The mechanism may also be so designed that only the amount of thread to be taken up during contraction is controlled, thereby simplifying the control function of the central processing unit. For example, the desired length of needle thread may be extracted with rotation of the loop-taker to form a thread loop of fixed size, and the optimum thread take-up length determined according to work thickness and stitch length. The optimum take-up length is the length needed to form the fixed loop minus the length required to form each stitch. Thus, according to the present invention, the thread take-up mechanism and the mechanism for setting the length of needle thread necessary for stitch formation are integrally formed for automatic thread handling, in contrast to the customary procedure in which these two operations were separated from each other.

Thus, the system of the present invention enables the mechanical structure of the automatic thread handling system to be simplified considerably. As a result, the system can be easily built into the limited space available in the sewing machine head, while at the same time increasing the operational speed and reliability of the machine. Other features of the invention will become apparent from the following description of preferred embodiments thereof.

DESCRIPTION OF THE PREFERRED EMBODIMENTS

An embodiment of a sewing machine in which the automatic thread handling system is incorporated is hereinafter described by referring to the accompanying drawings.

Figure 1:
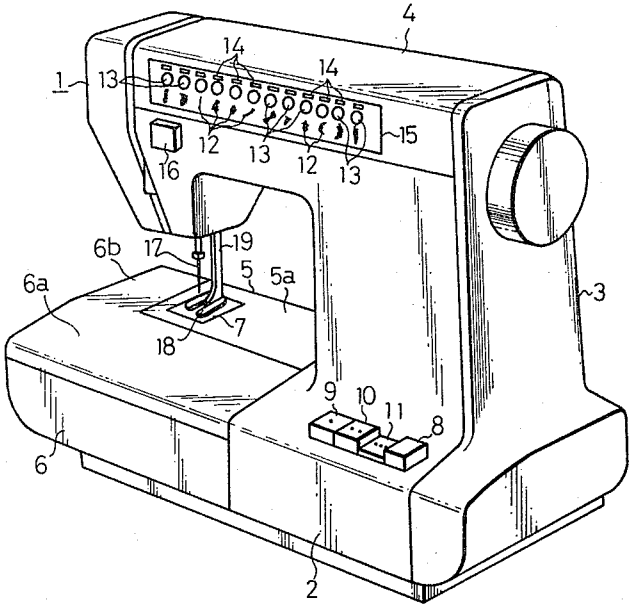
FIG. 1 is a perspective view of a sewing machine incorporating an automatic thread handling system embodying the present invention.

In FIG. 1, a sewing machine 1 comprises a base 2, a standard 3 and a head portion 4. To the left rear side of the base 2 a lower arm having a work supporting surface 5*a* is projected horizontally and to the left front side thereof is detachably mounted an auxiliary plate 6. The plate 6 is in the form of a letter L consisting of an elongated auxiliary plate portion 6*a* extending towards the left-hand side and an auxiliary plate portion 6b extending towards the rear. A throat plate 7 is mounted to the left-hand side on the upper surface of the lower arm 5. Towards the front side on the upper surface of the base 2 are mounted a self lock-type power switch 8 and self lock-type speed setting switches 9, 10, 11 designed for low-, medium- and high-speed operation, respectively.

On the front surface of the head portion 4 is a pattern panel 15 with a number of symbol marks 12 for various stitch patterns, light emitting diodes (LEDs) 13, self restoring type pattern selection switches 14, and a self restoring type start stop switch 16. Upon actuation of a selected one of the switches 14, the symbol mark corresponding to the selected pattern is indicated by illumination of the corresponding LED 13 located between the switch 14 and the mark 12. The start stop switch 16 is so designed that, upon actuation thereof, a drive motor mounted in the head portion is energized and, upon a further actuation thereof, the drive motor is de-energized.

Figure 2:
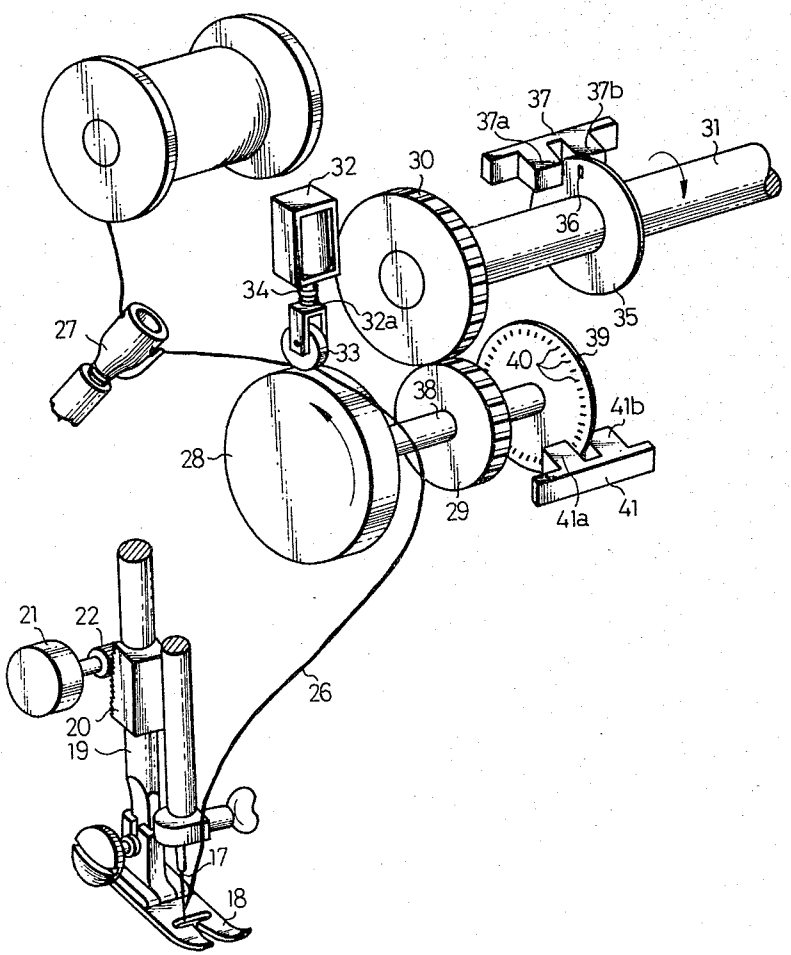
FIG. 2 is a perspective view of a portion of the internal mechanism of a first embodiment of the invention.

Upon actuation of the drive motor, a needle 17 performs simultaneously a vertical reciprocating motion and a jogging motion with a predetermined bight as determined by a lateral jogging mechanism (not shown) mounted within the head portion 4. A feed dog (not shown) also performs a fabric feed motion by a work feeding mechanism (also not shown) mounted within said lower arm 5. A looptaker (not shown) mounted in the lower arm 5 is also driven for expanding a thread loop. A presser foot 18 is carried by a presser bar 19, as shown in FIG. 2, and is designed to press the workpiece with a predetermined pressure by a pressure setting mechanism (not shown) and to be vertically movable by a presser lift lever (not shown). A rack 20 is secured to the upper part of the presser bar 19 and meshes with a gear 22 operatively connected to a movable terminal of a potentiometer 21. The gear 22 is driven by vertical movement of the presser bar 19, and the potentiometer 21 provides an analog output corresponding to the angle of rotation of the gear 22 so that the thickness of the workpiece may be determined on the basis of the analog output.

Figure 4:
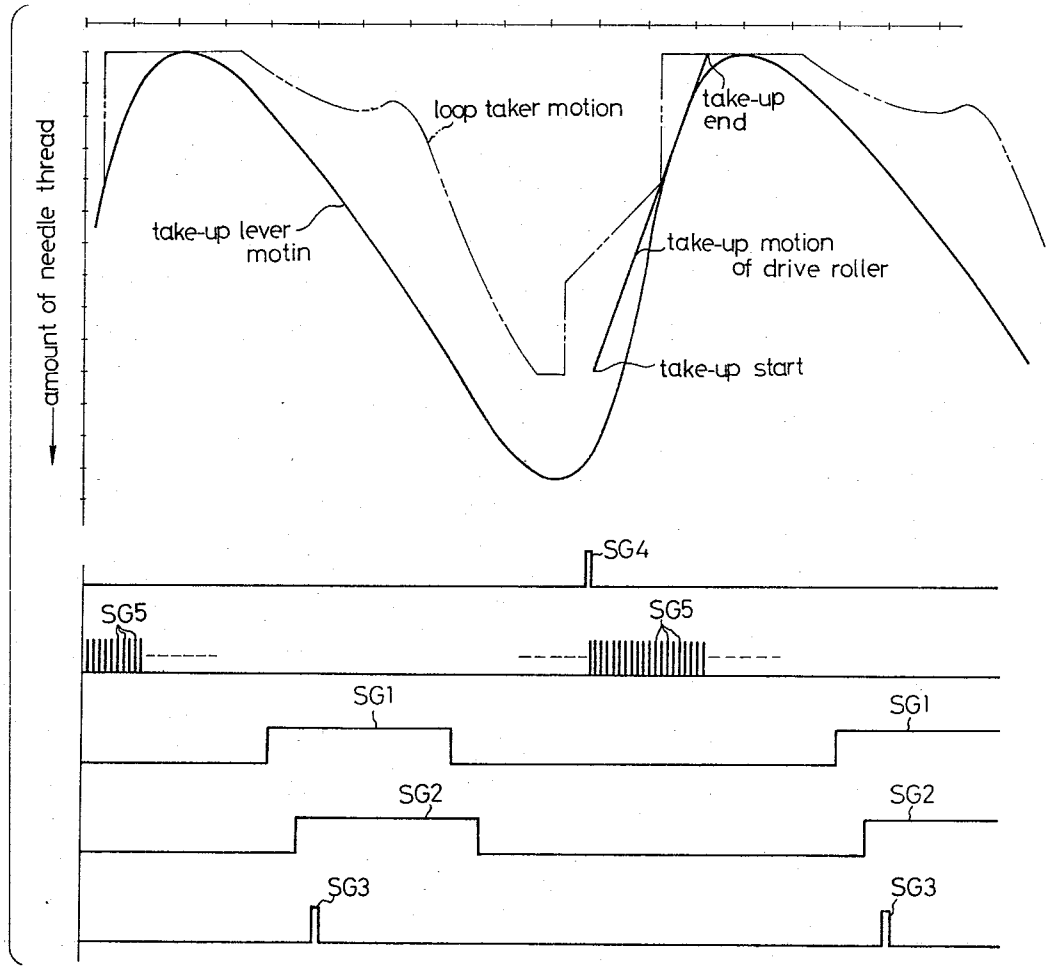
FIG. 4 is a diagram showing certain operational characteristics of the sewing machine in a stitch forming cycle, and a timing diagram illustrating the thread take-up operation.

A needle position sensor 23 (FIG. 3) is mounted on the main shaft of the sewing machine to detect the position of the needle 17 or, more particularly, as shown in FIG. 4, to provide a needle position indicating signal SG 1 which rises and falls when the needle 17 is raised above the throat plate 7 or lowered therebelow, respectively. A read-out timing pulse generator 24 (FIG. 3) provides a timing pulse SG 2 which rises shortly after the needle 17 is lowered below the plate 7 from above and falls shortly after the needle 17 is raised above the plate 7 from below, as shown in FIG. 4, and a work thickness sensing timing pulse generator 25 (FIG. 3) provides a work thickness timing pulse SG 3 shortly after the rising of pulse SG 2, as also shown in FIG. 4.

The automatic thread regulating device of the sewing machine 1 will be described with reference to FIG. 2.

In FIG. 2, a needle thread 26, reeled out from a bobbin mounted in the head portion 4 of the sewing machine 1, is passed through an eye of the needle 17 by way of a suction device 27 and the surface of drive roller 28. The roller 28 is connected by gears 29, 30 to an upper shaft 31 operatively connected to the main shaft and is continuously rotated in a direction to raise the needle thread 26. A solenoid 32 is mounted above the roller 28, and a driven roller 33, mounted on the solenoid armature 32a, is biased against the periphery of the roller 28 by a spring 34 for clamping the needle thread 26 so that it may be taken up toward said suction device 27. The thread 26 to be taken up is sucked by said suction device 27 and the thread thus taken up is held under suction within the suction device 27. The device 27 is connected to a suction pump by an electromagnetic valve (not shown) which is opened for initiating the suction operation upon de-energization of the solenoid 32 and closed for terminating the suction operation upon energization of the solenoid 32.

When the solenoid 32 is energized and the roller 33 is raised against the force of spring 34, the needle thread 26 is relased from the clamping pressure exerted by rollers 28, 33 and may be easily taken out during expansion of the upper thread loop by the looptaker.

A rotary disc 35 is secured to the upper shaft 31 and a through-slit 36 is formed in this disc 35. For sensing the passing of the slit 36 of the disc 35 in the course of rotation thereof, a thread take-up start pulse generator 37 consisting of a light emitting section 37a formed by an LED and a sensor section 37b formed by a phototransistor encircles the disc 35. The generator 37 is so designed and constructed that, when the expanding process for the thread loop has come to a termination, the generator provides a thread take-up start pulse signal SG 4, as shown in FIG. 4.

A rotary disc 39 is secured to a drive shaft 38 of the drive roller 28, and a multiplicity of through-slits 40 are formed concentrically and at equidistant intervals in the disc 39. For sensing the passing of the slits 40 of the disc 39 in the course of rotation thereof, a thread take-up timing pulse generator 41, consisting of a light emitting section 41a formed by an LED and a sensor section 41b formed by a phototransistor, encircles the disc 39. In the present embodiment, a distance $\theta$ between adjacent slits 40 in the disc 39 is so selected that, for each rotational movement of 5 mm by the roller 28 (wherein $r\theta = 5$ mm, r stands for radius of the drive roller 28 and $\theta$ is indicated in radians), one thread take-up timing pulse SG 5 is generated by the generator 41.

A drive control circuit, enclosed in the sewing machine, will now be described by referring to the block diagram of FIG. 3.

Figure 3:
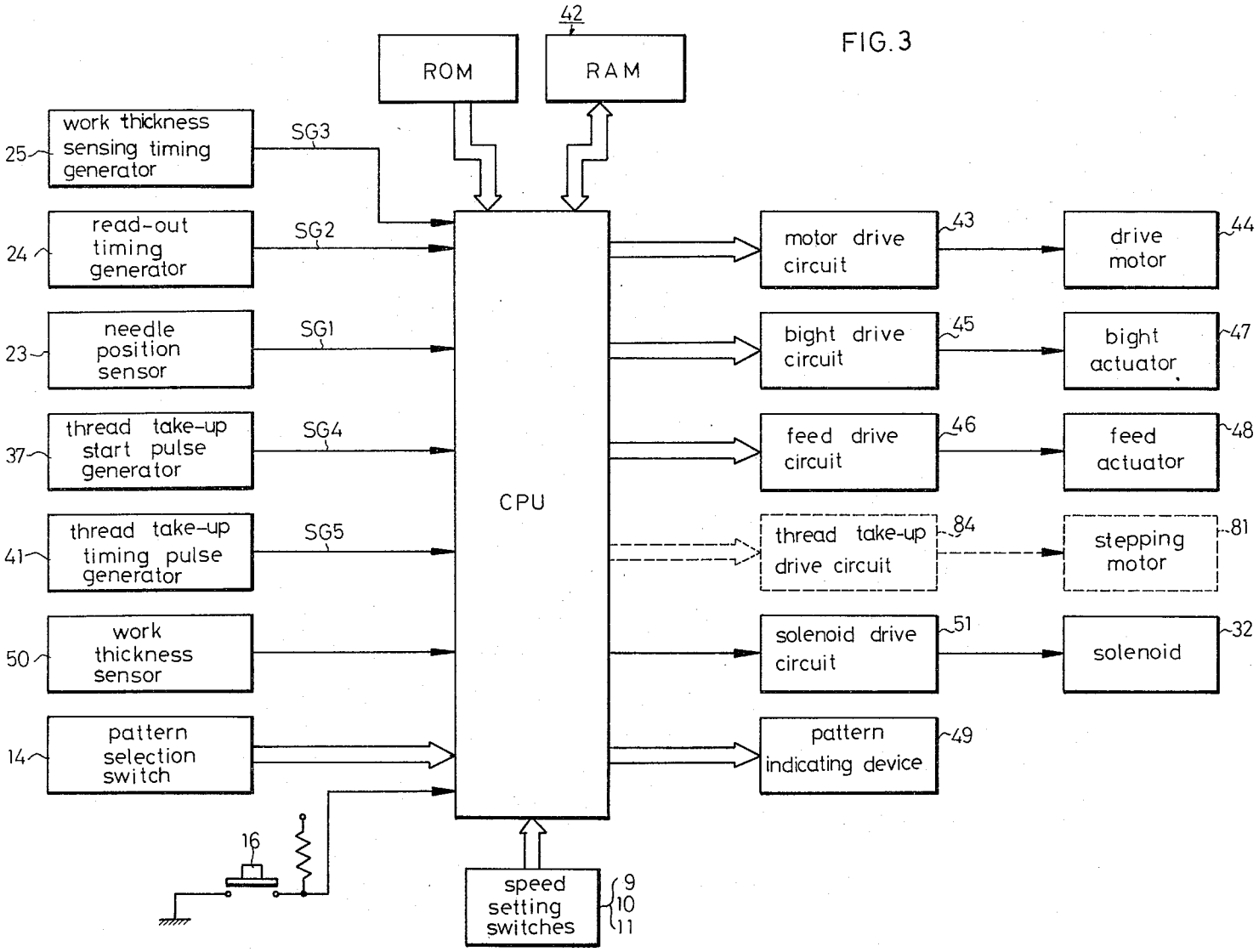
FIG. 3 is a block diagram of the electrical control system for controlling the sewing machine of FIGS. 1 and 2.
Figure 5A:
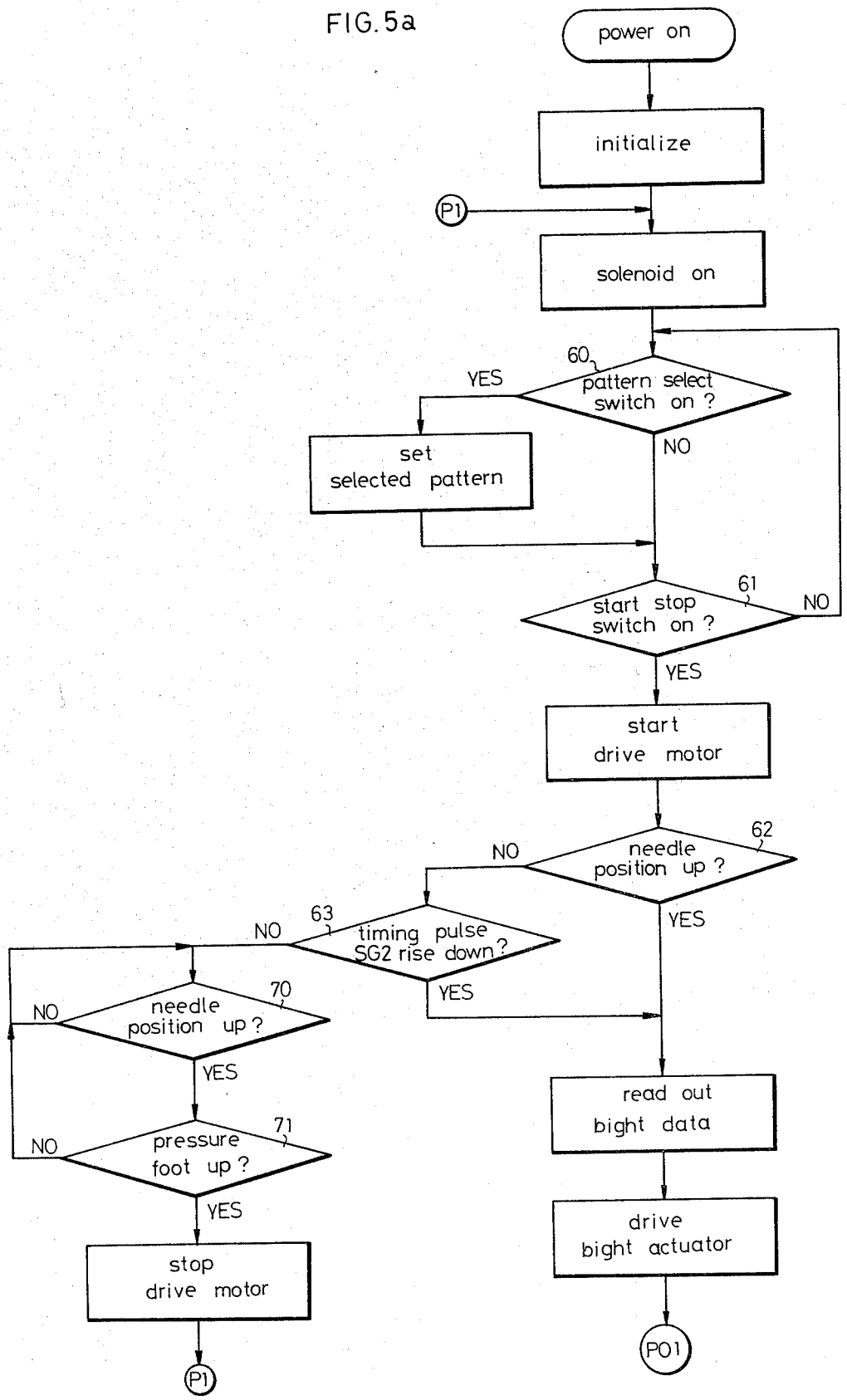
FIGS. 5*a*, 5*b* and 5*c* are flow charts illustrating the operation of the sewing machine of FIGS. 1 and 2 with the control system of FIG. 3.
Figure 5B:
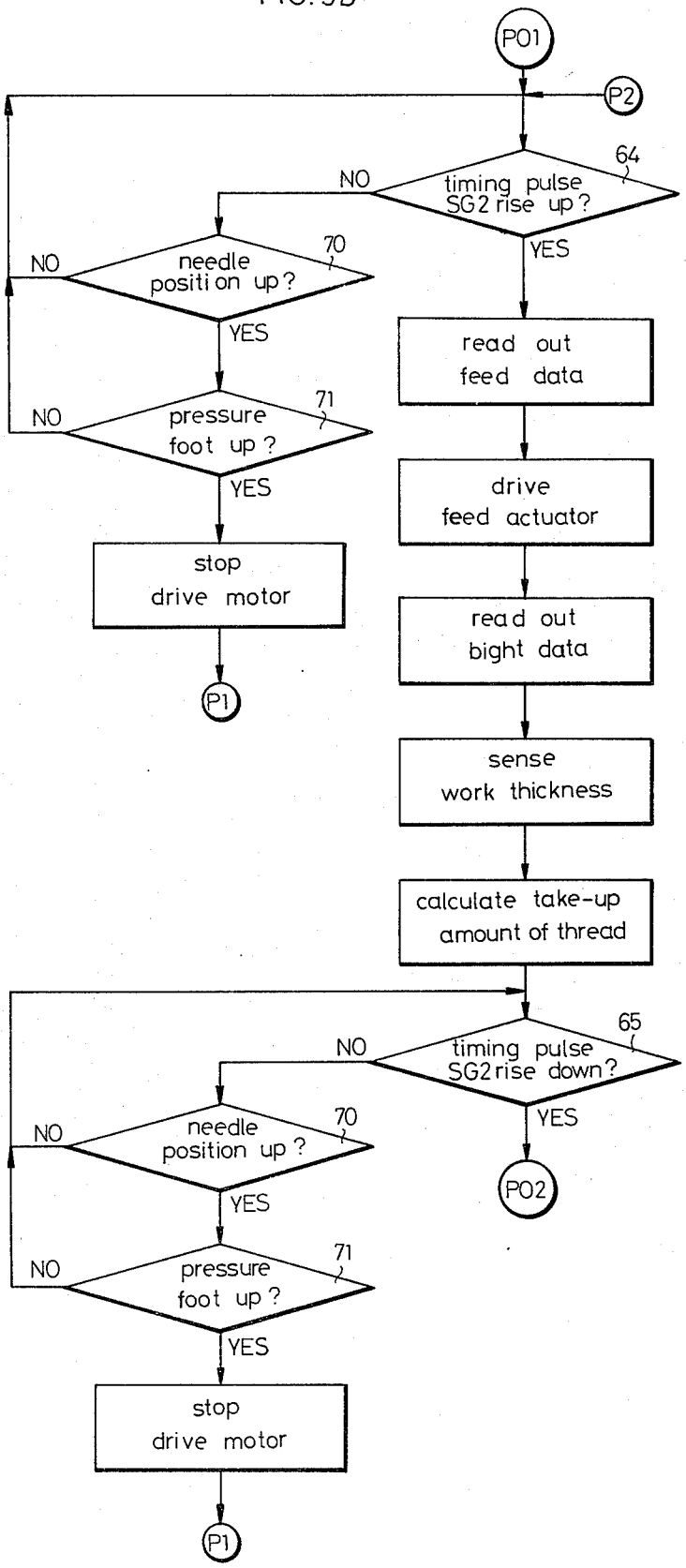
Figure 5C:
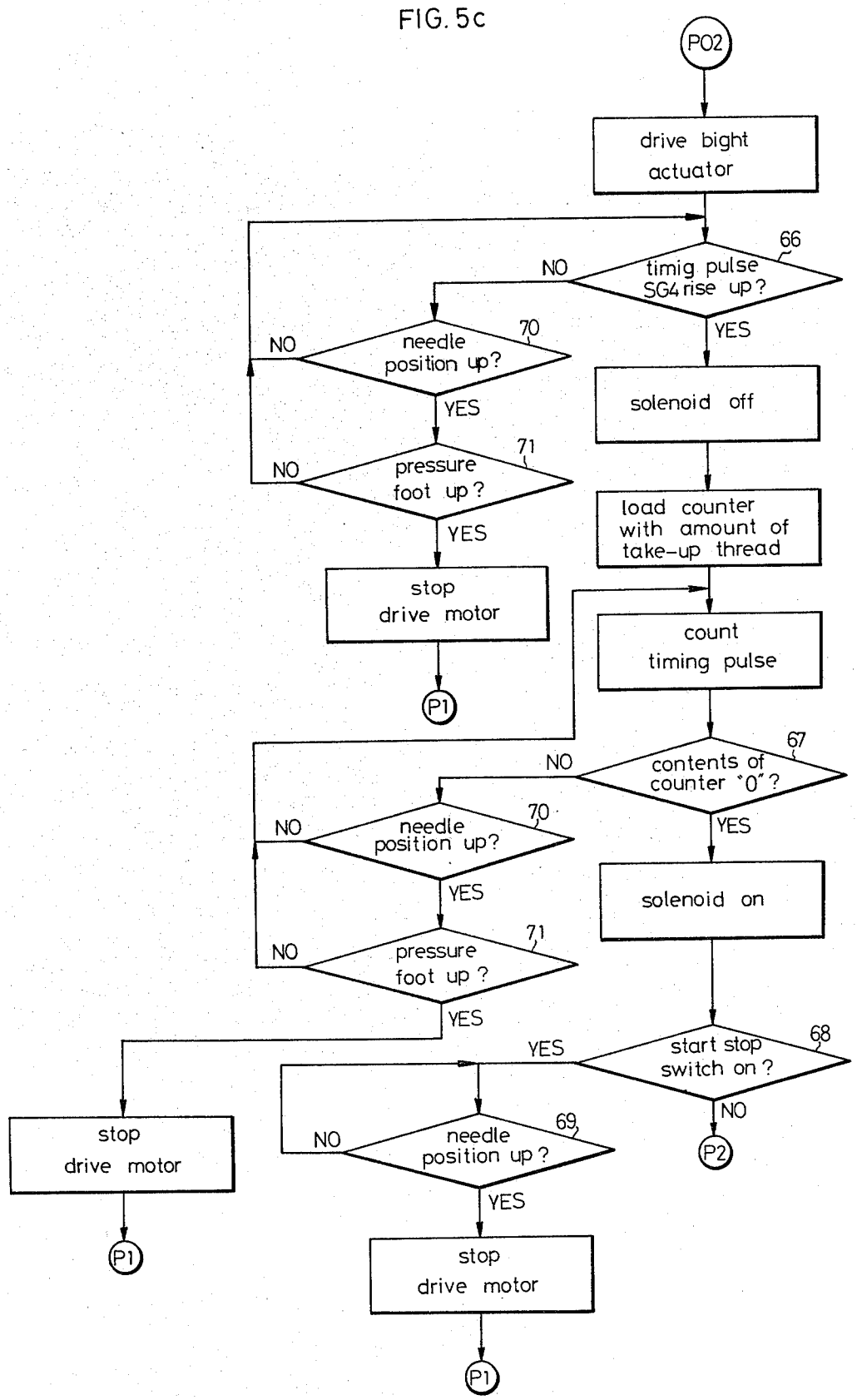

In FIG. 3, a micro-computer 42 is composed of a central processing unit (CPU), a read only member (ROM) and a random access memory (RAM). The CPU provides a control signal to a motor drive circuit 43, in accordance with a control program stored in ROM, and in response to both the ON signal of switch 16 and the speed setting signals from switches 9, 10, 11, for controlling the drive motor 44 at the selected rotational speed. The CPU also acts, in sequential response to rising and falling of the signal SG 2 from the pulse generator 24, for sequential read-out from ROM of data representing the bight and feed for each stitch pattern selected by a switch 14 and for providing such data to a bight drive circuit 45 and a feed drive circuit 46.

A bight actuator 47 for the lateral jogging mechanism and a feed actuator 48 for the work feeding mechanism determine, for each stitch, the jogging position of the needle 17 and the position of a regulator for setting the feed amount and the feed direction of the feed dog. The CPU also provides a pattern indication signal to an LED 13 of a pattern indicating device 49, in accordance with the pattern selection signal provided by the selected switch 14, for lighting the LED 13 situated above the selected mark 12.

A work thickness sensor 50 provides the CPU with a digital signal converted from the analog signal from the potentiometer 21. Each time the timing pulse SG 3 from generator 25 is supplied to the CPU, the digital signal from the sensor 50 is stored as work thickness in RAM. The thread length required for each stitch formation is calculated by the CPU on the basis of the digital data stored in RAM as work thickness and the stitch data representing the length or distance between successive stitches and the parameters representing the characteristics of pattern to be formed. Further, the CPU calculates the optimum amount of thread to be taken up for each stitch formation by subtracting the required thread length from the length of the thread loop. The generator 37 provides the thread take-up start pulse signal SG 4 to the CPU which then provides an instruction to a solenoid drive circuit 51, based upon said pulse signal, for de-energizing the solenoid 32 and starting the thread take-up operation. The CPU also counts the number of signal pulses SG 5 from said generator 41 for determining the length of needle thread actually taken up by the drive roller 28 for comparison with the optimum amount calculated by the CPU. The CPU operates to energize the solenoid 32, when the drive roller 28 has taken up the optimum length of needle thread 26 by providing a thread take-up stop signal to the drive circuit 51.

The operation of the automatic thread adjustment device in the sewing machine described above will be elucidated by referring to the flow charts shown in FIGS. *5a, 5b* and *5c* and illustrating the operation of the micro-computer 42.

It is assumed that a desired one of switches 9, 10, 11 is actuated for selecting the operational speed of the sewing machine, the power switch 8 is turned on, the CPU state is initialized, the information in ROM for the formation of a straight stitch is rendered effective, and the LED 13 corresponding to the symbol mark 12 of the straight stitch is illuminated. The CPU also provides a command signal to the drive circuit 51 for energizing the solenoid 32, thereby disengaging the driven roller 33 from the drive roller 28. The needle thread 26 is thus released from clamping by the rollers 28, 33 and can be taken out.

Next, the state of the selection switches 14 is checked by an instruction 60 and, if the switch state is changed by selection of new pattern, the CPU invalidates the straight stitch information and validates the information in ROM for the formation of the selected stitch pattern. The CPU also provides a control signal to the pattern indicating device 49 for illuminating the LED 13 corresponding to the mark 12 for the stitch pattern. If a pattern has not been selected, the information for the straight stitch is still validated in the CPU.

The state of start stop switch 16 is then checked, according to an instruction 61. If this switch is turned on, the CPU sends out a drive control signal to the motor drive circuit 43 for driving the motor 44 at the speed selected by the switches 9, 10, 11. The motor 44 is driven in this way and the needle 17 starts to move downwardly from its uppermost position.

When the needle 17 has been determined, in accordance with an instruction 62, to be in its upper position above throat plate 7, the CPU reads out bight data for the first stitch in the selected stitch pattern from ROM and provides the bight data to the bight drive circuit 45, as a position control signal. The circuit 45 then controls the driving of the bight actuator 47 based upon said control signal. When the needle 17 has been determined, in accordance with instruction 62, to be in its lower position, (as when sewing has been started from the lower stop position for the needle), the fall of the timing pulse signal SG 2 from generator 24 is sensed in accordance with an instruction 63, the bight data is read out in the above manner and driving of the bight actuator 47 is controlled accordingly.

The rise of the timing pulse signal SG 2 from generator 24 is checked in accordance with an instruction 64. If such rise has been sensed, the CPU reads out the feed data for the feed dog from ROM and provides same to the feed drive circuit 46 as a position control signal. The circuit 46 then operates to control the driving of the feed actuator 48 in accordance with said control signal. The CPU reads out bight data for the next stitch from ROM and stores same in a predetermined storage location in RAM. On the other hand, in response to the timing pulse signal SG 3 from generator 25, which is supplied shortly after the rise of the timing pulse signal SG 2 from generator 24, the CPU operates to determine the optimum take-up length of needle thread 26 for contracting the thread loop expanded by the looptaker, to be later described. As described above, the optimum length is based on the digital data from generator 50 representing work thickness and the stitch data representing the distance between successive stitches in the selected stitch pattern. The optimum take-up length is transiently stored in a predetermined storage location in RAM.

As the needle 17 reaches the lowermost position and moves upwardly therefrom, the needle thread 26 is seized at the beak of the looptaker which then starts the loop expanding operation. The thread 26 is thus further lowered (at this time, the needle thread 26 can be withdrawn as the solenoid 32 remains energized). As the needle 17 is raised above the throat plate 7, the workpiece is fed by the feed dog in accordance with the feed data.

The fall of the pulse signal SG 2 from generator 24 is checked in accordance with an instruction 65 and, if such fall is sensed (as when the needle 17 has slightly cleared the plate 7), the bight data stored in RAM is read out and supplied to said drive circuit 45 as a position control signal. The circuit 45 operates to control the driving of the bight actuator 47. Thus, the needle 17 performs a lateral motion according to the bight data, as it is again lowered from its uppermost position. During such driving control of the bight actuator 47, the thread loop is expanded to its maximum diameter by operation of the looptaker.

Next, the thread take-up start pulse signal SG 4 from thread take-up start pulse generator 37 (i.e. the pulse signal supplied after completion of the thread loop spreading process) is checked in accordance with an instruction 66. If such signal SG 4 is sensed, the CPU provides an instruction to the solenoid drive circuit 51 to de-energize solenoid 32, thereby starting the taking up of the needle thread 26. Simultaneously, the CPU operates to set the number corresponding to the needle thread take-up length, as held in RAM, in an internal counter in the CPU and to subtract the number set in the internal counter one by one in response to the thread take-up timing pulse signal SG 5 from generator 41. When the contents of the internal counter are determined to be equal to zero, in accordance with an instruction 67, the CPU provides a command to the drive cirucit 51 to de-energize the solenoid 62 and to terminate the take-up of needle thread 26. Thus, if the optimum take-up amount as determined by the CPU is 10 cm, the number "20" is set in the internal counter in the form of a binary number. The internal counter of the CPU performs a subtractive operation in response to the thread take-up timing pulse signal SG 5 supplied from generator 41 (one such pulse signal being supplied for each 5 mm of take-up of the needle thread 26 caused by rotation of the drive roller 28), so that the subtractive operation ceases when the twentieth pulse signal SG 5 has been supplied and the counter contents have decreased to zero. As a result, the needle thread 26 is taken up by 10 cm by cooperation of the drive roller 28 and the driven roller 33.

As the solenoid 32 is turned on to enable the thread 26 to be lowered, one stitch is set in the workpiece, and the next instruction 68 is ready to be carried out. If, in accordance with such instruction 68, the switch 16 is determined to be off or out of operation, the CPU executes the above instruction 64 for setting the next stitch. The CPU reads out the bight and feed data sequentially and the selected stitch pattern is formed in the work. The solenoid 32 is turned on and off each time for accurately taking up and down the needle thread 26.

As the sewing work approaches completion, the operator actuates the start stop switch 16. The activated state of the switch 16 is sensed in accordance with the instruction 68, and the needle position sensing signal SG 1 from sensor 23 is checked to determine when the needle 17 is in its upper position. The CPU then provides a stop command to the drive circuit 43 for stopping the needle 17 at the predetermined position. The sewing operation is now completed and the machine operation is stopped.

Simultaneously with the command to de-energize solenoid 32, the CPU provides a control signal to open the electromagnetic valve of the suction device 27 for suction of the thread 26. In addition, simultaneously with the command to energize solenoid 32, the CPU provides a control signal to close the valve. By such arrangement, the length of thread taken up by the drive and driven rollers 28, 33 is held under suction within said suction device 27 to prevent the thread 26 from being entwined about neighboring members due to slack in the upper portion of the thread.

Furthermore, as the operator actuates a lever during sewing to raise the presser foot 18, the signals from sensors 23, 50 are immediately checked in accordance with instruction 70, 71. If such raising of the pressor foot 18 is sensed, the drive motor 44 terminates its operation for operational safety.

Figure 6:
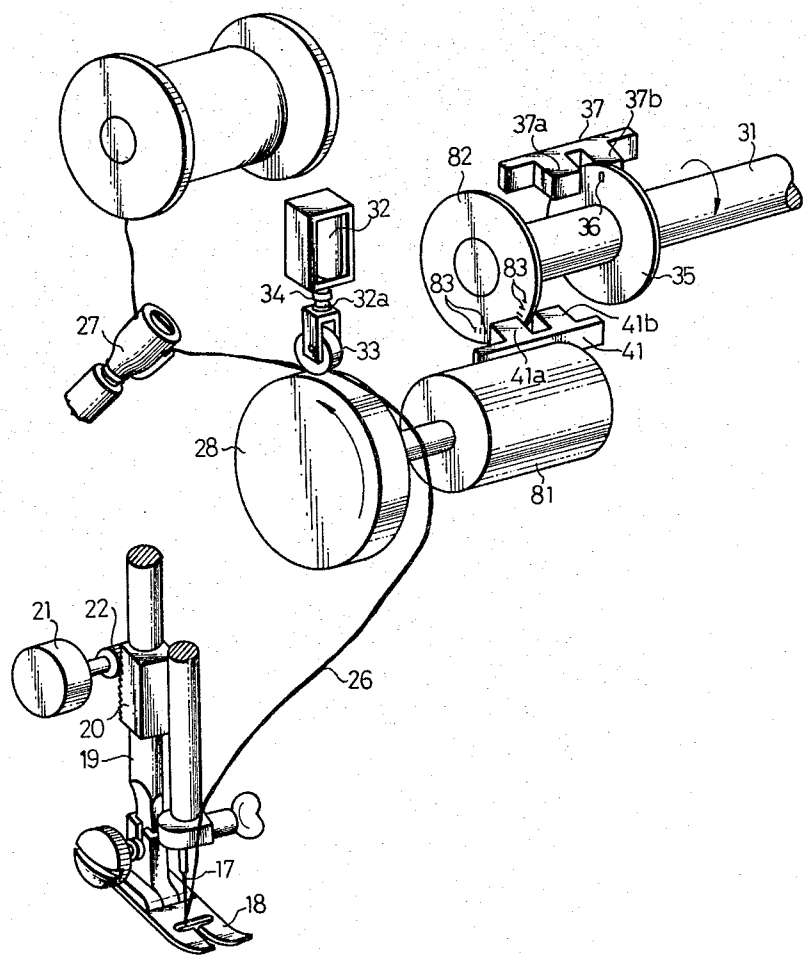
FIG. 6 is a perspective view of a portion of the internal mechanism of a second embodiment of the invention.

Reference is made to FIG. 6 for explanation of the second embodiment of the present invention.

This embodiment differs from the foregoing only as to the manner of driving the drive roller 28, which is described in detail below.

The drive roller 28 is secured to a drive shaft of a stepping motor 81 and, on top of the roller 28, there is provided the solenoid 32 with a driven roller 33 mounted thereon as in the preceding embodiment. On said upper shaft 31 is mounted, in addition to the rotary disc 35, a disc 82 corresponding to the rotary disc 39 for generating the thread take-up timing pulse signals. Twenty through-slits 83 are formed about the circumference of the disc 82 and at equal angular distances from one another, and the rotational travel of these slits 83 is sensed by the light emitting section 41*a* and the sensor section 41*b* of the thread take-up timing pulse generator. The disc 82 is located in relation to the disc 35 in such a manner that the rotational travel of the twenty slits 83 in the disc 82 is sensed sequentially at the same time that the generator 37 senses the rotational travel of the slit 36 of the disc 35. In addition, the spacing between adjacent slits 83 of the disc 82 is so selected that a slit 83 is moved between the sections 41*a* and 41*b* of the generator 41 each time the thread 26 is taken up 5 mm by the drive roller 28 driven by said stepping motor 81 and cooperating with the driven roller 33.

To the CPU of the micro-computer 42 is connected a thread take-up drive circuit 84 operative to control the driving of the stepping motor 81 as indicated by the broken line in FIG. 3. During the time that the solenoid 32 remains de-energized (the time necessary for taking up the calculated length of the needle thread 26), the drive circuit 84 responds to the respective timing pulse signals from pulse generator 41 to receive from the CPU a step command for driving the stepping motor 81.

Thus, when a pulse signal has been supplied from the pulse generator 37 as described above (that is, upon completion of the expanding process of the thread loop) the solenoid 32 is de-energized and the driven roller 33 energizes the drive roller 28 for clamping the thread 26 therebetween. The stepping motor 81 is simultaneously driven into operation and remains activated until the calculated thread length has been taken up and the solenoid 32 is turned on. Thereafter, at the same time that a command is supplied from the CPU to the drive circuit 51, a stop command is issued to said drive circuit 84 to stop the stepping motor 81. Thus, the motor 81 is stopped and the thread 26 is disengaged from the drive and driven rollers 28, 33. The stepping motor 81 remains deactivated until the next pulse signal is supplied from pulse generator 37.

Various modifications may be made to the automatic adjustment device described above. For example the stepping motor 81 of the second embodiment shown in FIG. 6 may be a reversible motor and the thread take-up drive circuit 84 may be modified for enabling positive supply of needle thread 26 to the needle 17 and take-up of the so supplied thread. The slits used for setting the timing for supply and take-up of the thread 26 may then be formed on the overall circumference of the disc 82. In this modification, the amount of needle thread to be extracted from thread supply 26 is determined by the mechanical structure of the sewing machine and the thread take-up length is calculated by the central processing unit (CPU).

What is claimed is:

1. In a sewing machine having a thread supply, a thread carrying needle, a thread path between the supply and the needle, and a looptaker seizing thread from the supply for forming a loop of fixed size for forming stitches in cooperation with the needle, an automatic thread handling system for controlling the thread comprising;

thread take-up means comprising reverse feed roller means positioned along said path and operable to positively move the thread in a direction for taking up the thread of said loop released from said looptaker only during discrete time periods, controllable driving means operative to impart movement to said thread take-up roller means and to controllably vary the length of thread taken up, sensing means for sensing the thickness of a workpiece being sewn and for generating thickness data corresponding to the sensed thickness, means for generating stitch data corresponding to the distance between successive stitches to be formed in said workpiece, means for generating a thread take-up start signal in timed relation to termination of the expansion of said loop, and data processing means for calculating a desired length of thread to be taken up based on said thickness data and said stitch data, said data processing means being responsive to said thread take-up start signal for controlling the operation of said driving means to positively take-up the thread for a determined time period according to the desired length calculated thereby.

2. An automatic thread handling system as set forth in claim 1, wherein said thread take-up reverse feed roller means includes two rollers for holding said thread therebetween, and said driving means imparts rotation to said rollers.

3. An automatic thread handling system as set forth in claim 2, wherein said driving means includes means for rotating at least one of said rollers during sewing and an actuator operative to engage said rollers with each other, and said data processing means controls the engagement of said rollers.

4. An automatic thread handling system as set forth in claim 2, wherein said driving means includes a stepping motor operatively connected with one of said rollers, and said data processing means calculates the desired number of steps to be effected by said stepping motor based on said thickness data and stitch data and controls the operation of said step motor in accordance with said calculated step number.

* * * * *